US011854517B2

(12) United States Patent
Dickinson et al.

(10) Patent No.: US 11,854,517 B2
(45) Date of Patent: Dec. 26, 2023

(54) SOUNDBOARDS AND BACKBOARDS FOR ACOUSTIC STRINGED INSTRUMENTS

(71) Applicants: Jay S. Dickinson, Portland, OR (US); Maxwell R. Dickinson, Portland, OR (US)

(72) Inventors: Jay S. Dickinson, Portland, OR (US); Maxwell R. Dickinson, Portland, OR (US)

( * ) Notice: Subject to any disclaimer, the term of this patent is extended or adjusted under 35 U.S.C. 154(b) by 97 days.

(21) Appl. No.: 17/494,034

(22) Filed: Oct. 5, 2021

(65) Prior Publication Data

US 2022/0108671 A1 Apr. 7, 2022

Related U.S. Application Data

(60) Provisional application No. 63/088,628, filed on Oct. 7, 2020.

(51) Int. Cl.

| | |
|---|---|
| ***G10D 3/02*** | (2006.01) |
| ***G10D 1/08*** | (2006.01) |
| ***G10D 3/22*** | (2020.01) |

(52) U.S. Cl.

CPC ..... *G10D 3/02* (2013.01); *G10D 1/08* (2013.01); *G10D 3/22* (2020.02)

(58) Field of Classification Search

CPC ..... G10D 3/02; G10D 1/08; G10D 3/22

See application file for complete search history.

(56) References Cited

U.S. PATENT DOCUMENTS

2013/0042739 A1* 2/2013 McPherson ..... G10D 3/02 29/896.22

2017/0350157 A1* 12/2017 Knudsen ..... E04H 17/1448

* cited by examiner

*Primary Examiner* — Kimberly R Lockett

(74) *Attorney, Agent, or Firm* — Chernoff, Vilhauer, McClung & Stenzel, LLP

(57) ABSTRACT

Soundboards and backboards of an acoustic stringed instrument and methods of manufacturing the same are disclosed. In one embodiment, the soundboard or backboard includes a base having opposed top and bottom surfaces, a plurality of channels on the bottom surface of the base, and a plurality of braces that correspond to the plurality of channels and that are received in and attached to the plurality of channels. In one embodiment, the method includes shaping a board to a uniform nominal thickness and carving a plurality of channels on the board via a Computer Numerically Controlled (CNC) router. The method additionally includes attaching a plurality of braces that correspond to the carved plurality of channels such that the plurality of braces is received in the plurality of channels.

20 Claims, 9 Drawing Sheets

SOUNDBOARDS AND BACKBOARDS FOR ACOUSTIC STRINGED INSTRUMENTS

CROSS REFERENCE TO RELATED APPLICATIONS

This application claims the benefit of U.S. Provisional Patent Application Ser. No. 63/088,628 entitled "Brace Assembly and Relief Pockets for Soundboard and Backplate of Acoustic Stringed Instrument," which was filed on Oct. 7, 2020. The complete disclosure of the above application is hereby incorporated by reference for all purposes.

BACKGROUND

The present disclosure generally relates to soundboards and backboards of an acoustic guitar or other acoustic stringed instrument and process for creating the same. Generally, a guitar body comprises of components such as a soundboard (or front plate), a backboard (or back plate), rims, and braces. The soundboard is a frontal piece of the guitar containing the sound hole, and is typically constructed with a thin piece of wood approximately 100 mil (i.e., 2.54 millimeters) thick and reinforced with a set of braces on the immediate backside of the soundboard with other additional components. The backboard is the back piece of the guitar and is generally similar to the soundboard in construction, except that the backboard lacks a sound hole. Between the soundboard and the backboard, there is a rim with a width that separates the frontal soundboard and the opposing backboard to define an enclosure forming the interior or harmonic chamber of the guitar.

Braces are typically placed or attached to the surface of the backside of the soundboard and occupy the space or chamber between the soundboard and the backboard. The placement and design of the braces located on the backside of the soundboard are crucial, as the braces play an important role in the acoustic qualities of the sound produced by the guitar, and also have an impact on the structural integrity of the guitar, serving as structural supports between the soundboard and backboard. The braces also contribute to the mass of the top.

What is desired, therefore, are soundboards and backboards that effectively reduce the overall mass of the top and back of the guitar, while still remaining functional and retaining structural integrity for the braces to be attached to the boards, as well as a board design that allows for the mass and stiffness of the soundboard and backboard to be changed or adjusted to the user's liking or acoustic preference. Further, a brace assembly design is also desired, where the braces may achieve an optimal mass to stiffness ratio, i.e., the braces must be lightweight while also being stiff to withstand the string tension.

BRIEF DESCRIPTION OF THE DRAWINGS

For a better understanding of the disclosure, and to show how the same may be carried into effect, reference will now be made, by way of example to the accompanying drawings, which.

DETAILED DESCRIPTION OF PREFERRED EMBODIMENTS

Figure 1:
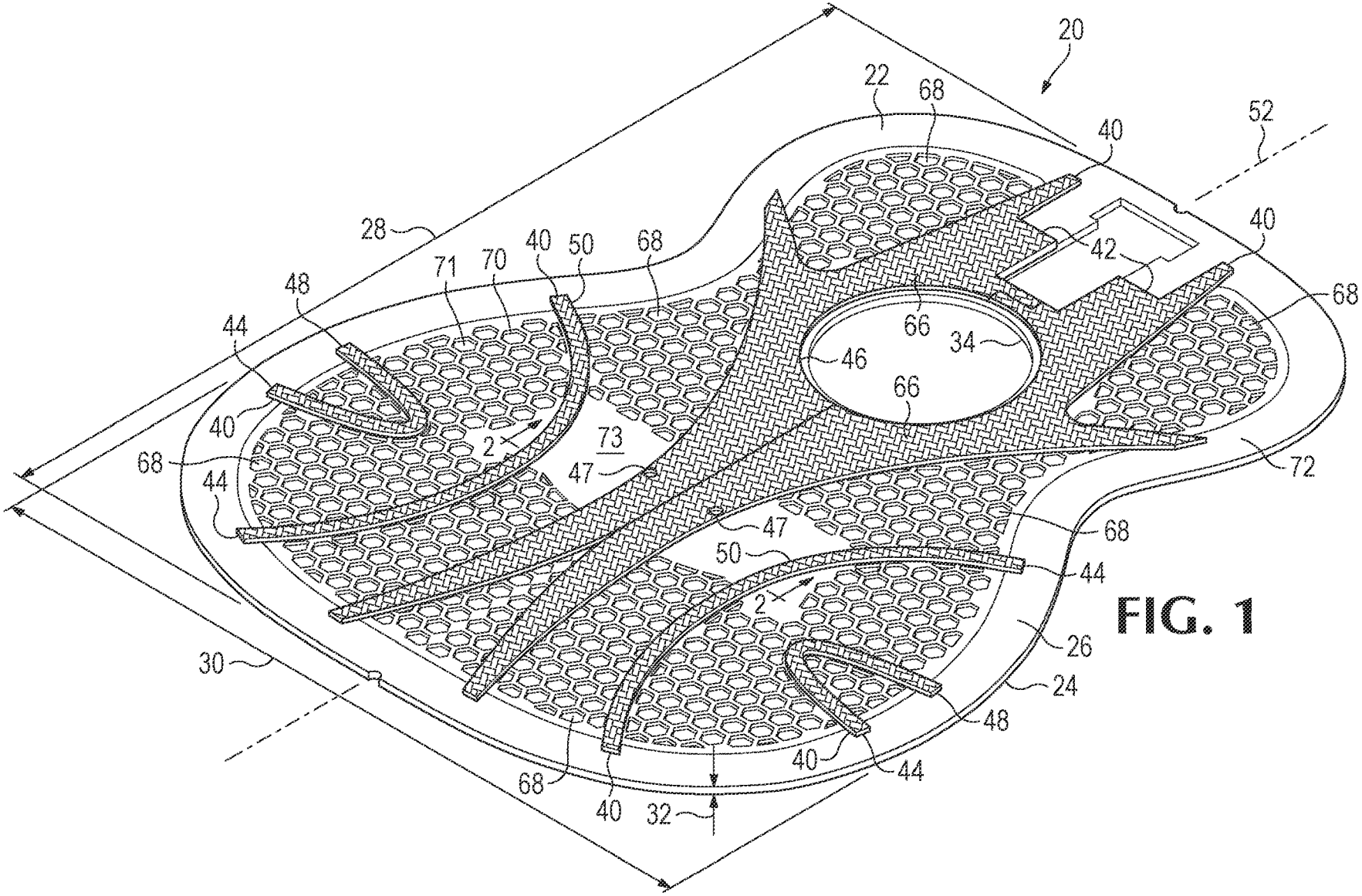
FIG. 1 is a bottom isometric view of an example of a guitar soundboard.
Figure 2:
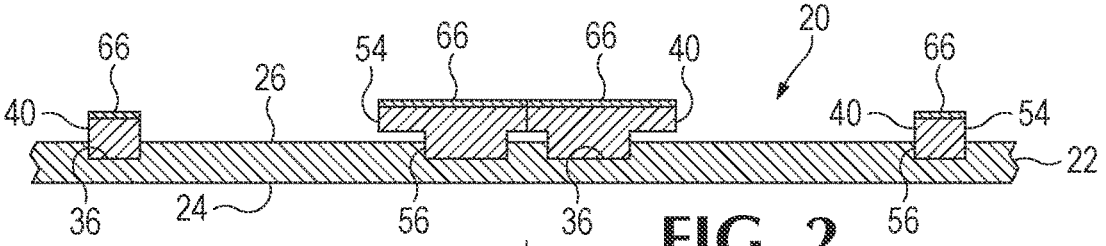
FIG. 2 is a sectional view of the guitar soundboard of FIG. 1 taken along lines 2-2 in FIG. 1.
Figure 3:
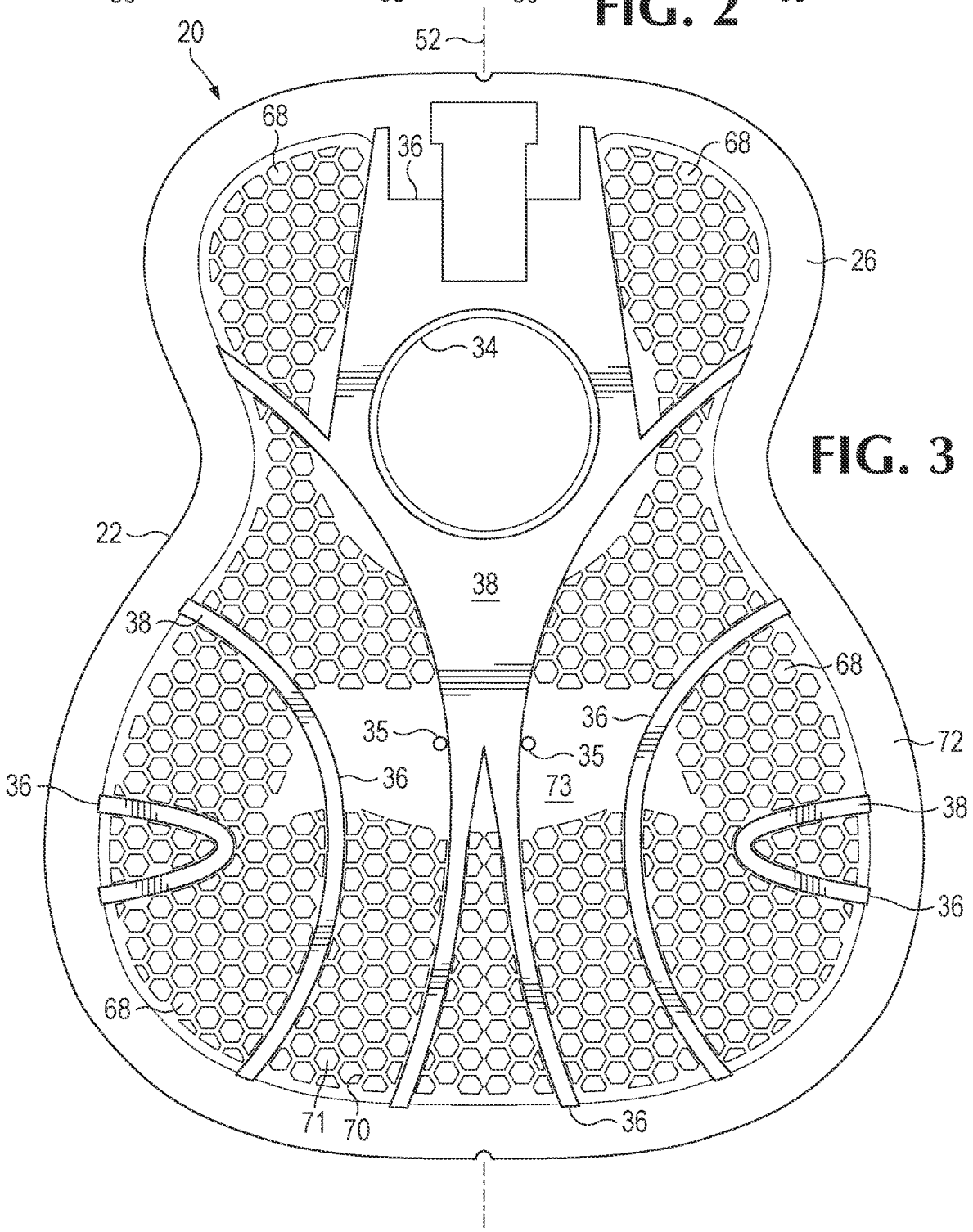
FIG. 3 is a bottom view of the guitar soundboard of FIG. 1 shown without braces.
Figure 4:
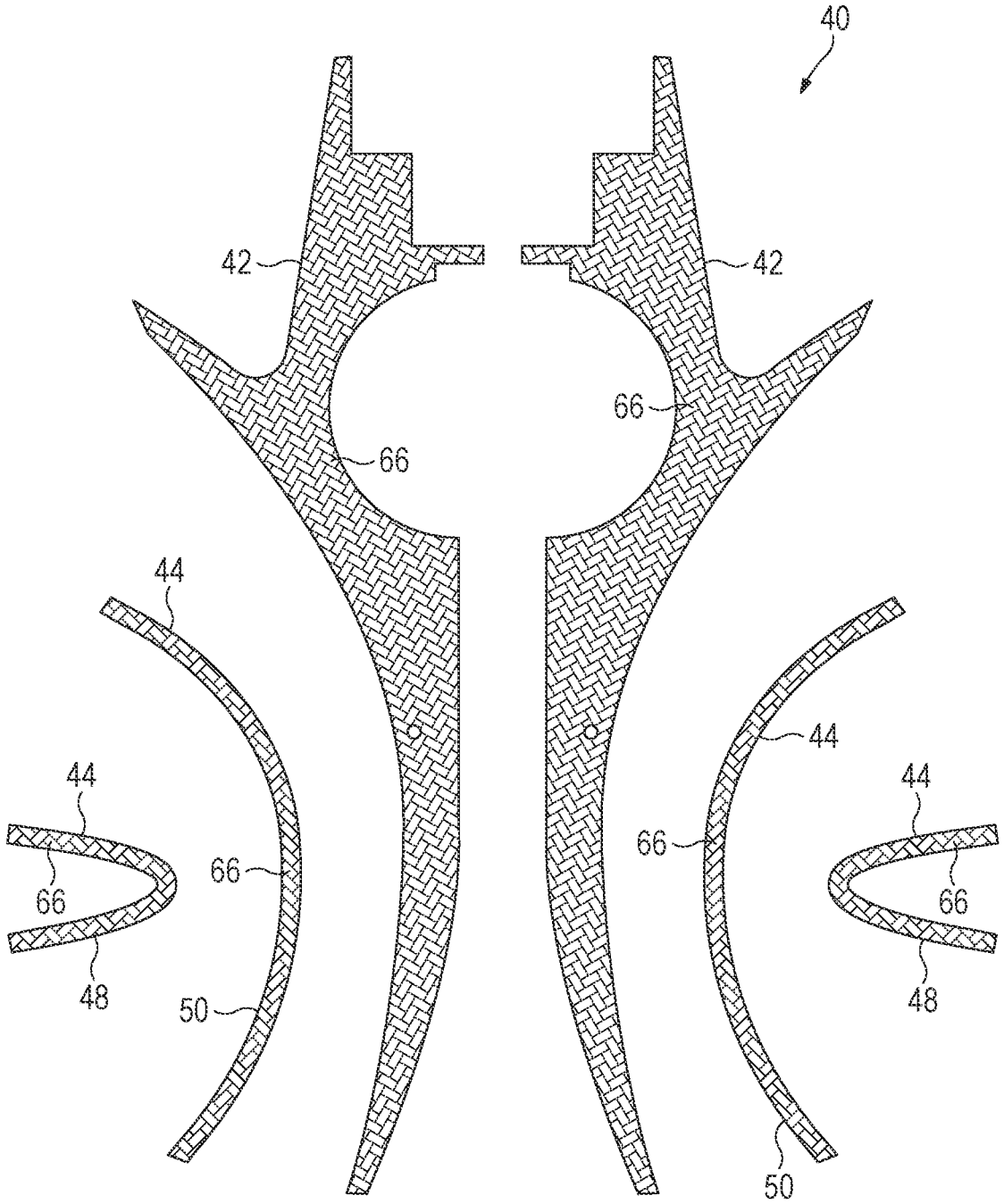
FIG. 4 is a bottom view of the braces of the guitar soundboard of FIG. 1 showing center braces spaced apart.
Figure 5:
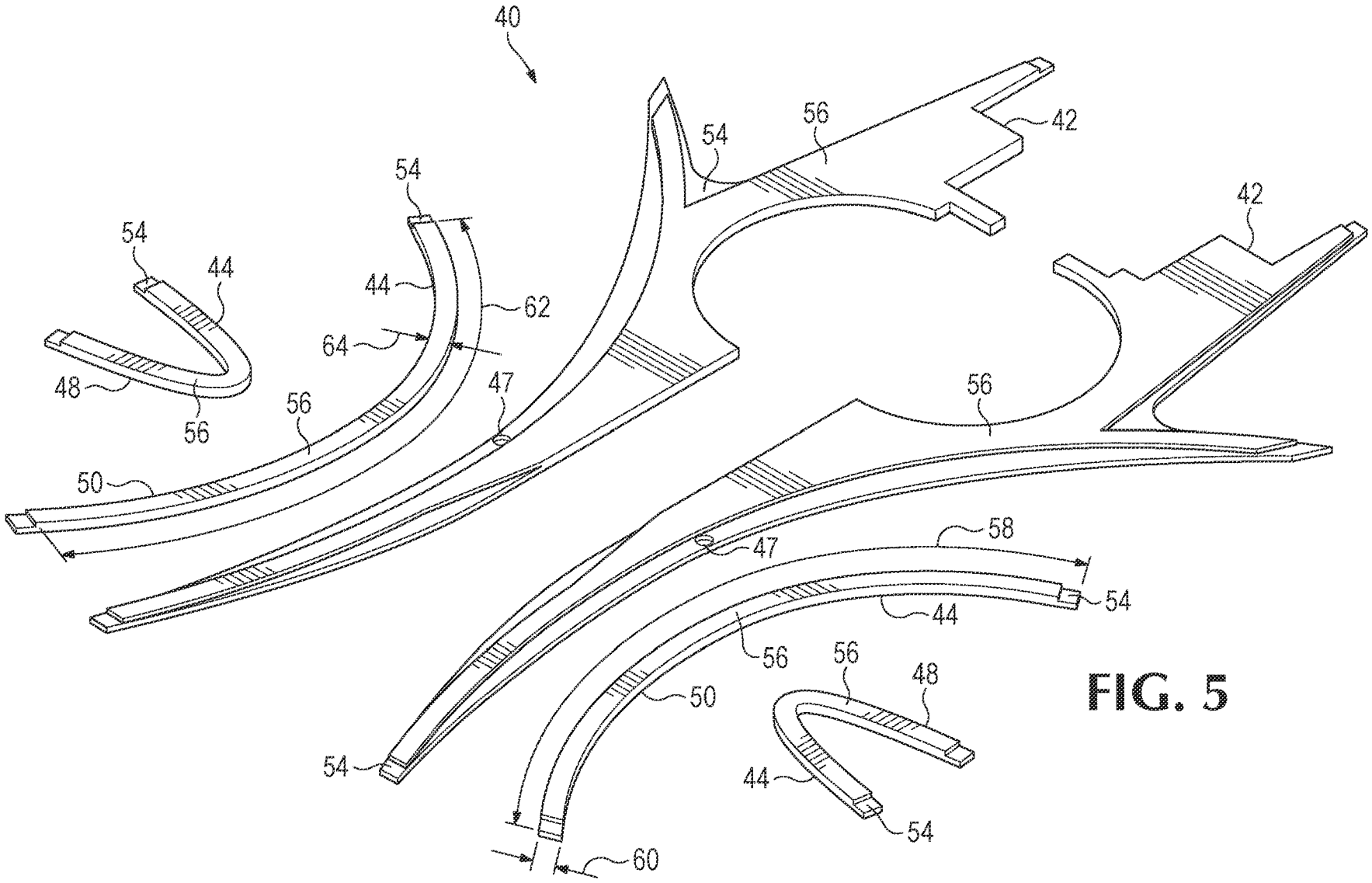
FIG. 5 is a top isometric view of the braces of FIG. 4.

Referring to FIGS. 1-5, an illustrative example of a soundboard 20 for an acoustic stringed instrument, such as a guitar, is shown. Unless explicitly excluded, soundboard 20 may include any structures and/or components of other soundboards or backboards of the present disclosure. The soundboard includes a base 22 having a top surface 24 and a bottom surface 26 that are opposed to each other. Additionally, base 22 has a length 28, a width 30, and a thickness 32. Thickness 32 may be generally uniform across length 28 and width 30. Additionally, the thickness may be nominal in that is provides a reduction of mass but with sufficient structural integrity and stiffness, such as about 0.090 inches to 0.115 inches (e.g., 0.1 inches). The base includes at least one soundhole 34, which may be round and/or other suitable shape(s) (e.g., ovals, F-holes, C-holes, rosettes, and/or D-holes). Additionally, base 22 includes a pair of holes 35 for attaching a bridge (not shown) on top surface 24.

Soundboard 20 includes a plurality of brace channels 36 on bottom surface 26. The brace channels are below the bottom surface so the thickness of soundboard 20 in those channels is less than thickness 32 of the portions of the soundboard without the brace channels (e.g., less than 0.1 inches). In other words, bottom surface 26 defines a first plane and bottom 38 of brace channels 30 are in a second plane generally parallel to and below the first plane. Brace channels 36 are sized and shaped to receive a plurality of structural braces 40. The depth of the brace channels may be the same or different from each other and generally is about 0.020 inches to 0.040 inches. Although brace channels 36 are shown to be rectangular-shaped or have a cross-section that is rectangular-shaped, other examples of soundboard 20 may alternatively, or additionally include brace channels that are shaped differently, such as square, trapezoidal, triangular, semi-circular, etc.

Braces 40 are received in brace channels 36 and are attached to those brace channels and bottom surface 26, such as via one or more adhesives. The braces may be any suitable shape(s) and/or size(s) to reinforce the soundboard, such as to withstand the tension of the strings. Additionally, braces 40 may be any suitable shape(s) and/or size(s) to influence the sound of the soundboard, which may be referred to as "tone braces." Braces 40 include center braces 42 and side braces 44. In the examples shown in FIGS. 1-5, center braces 42 have a length that is along a substantial portion of length 28 of base 22. Additionally, center braces 42 at least substantially mirror each other and forms a hole 46 that is co-axial with soundhole 34 and that has a diameter substantially the same or the same as the diameter of the soundhole. One or more portions of center braces 42 contact each other. Center braces 42 include a pair of holes 47 that corresponds with holes 35 of base 22 for attaching a bridge (not shown).

In the example shown in FIGS. 1-5, side braces 44 include a pair of U-shaped braces 48 and a pair of C-shaped braces 50. Unlike center braces 42 that contact each other, side braces 44 are spaced from each other and from the center braces. One U-shaped brace 48 and one C-shaped brace 50 is disposed on one side of center braces 42 and the other U-shaped brace and C-shaped brace is disposed on the other side of the center braces. In other words, center braces 42 are disposed between two side braces 44 and the other two side braces 44. In the example shown in FIGS. 1-5, center braces 42 and side braces 44 are arranged and/or shaped as substantial mirror images about a longitudinal axis 52 defined by base 22. For example, U-shaped braces 48 are mirror images about longitudinal axis 52 and C-shaped braces are mirror images about longitudinal axis 52. However, other examples of soundboard 20 may include braces 40 that are not arranged and/or shaped as substantial mirror images about the longitudinal axis.

Braces 40 includes a base longitudinal layer 54 and a channel longitudinal layer 56 formed with the base longitudinal layer. The base and channel longitudinal layers may be made of any suitable materials, such as one or more lightweight wood materials. Base longitudinal layer 54 has a length 58 and a width 60. Channel longitudinal layer 56 is received in brace channels 36 and has a length 62 and a width 64. For one or more of braces 40, length 62 of channel longitudinal layer 56 is substantially the same (or the same) as length 58 of base longitudinal layer 54, while width 64 of channel longitudinal layer 56 along at least a substantial portion (or all) of length 62 is the same or smaller than width 60 of base longitudinal layer 54 along the corresponding portion of length 58. In the example shown in FIGS. 1-5, side braces 44 have width 64 that is the same or substantially the same as width 60, while center braces 42 have width 64 that is smaller than width 60. Additionally, center braces 42 and side braces 44 have length 62 that is substantially the same (or slightly smaller) than length 58.

Braces 40 may include any suitable cross-section shape(s). In the example shown in FIGS. 1-5, center braces 42 have a T-shaped cross section having a T-top portion formed by base longitudinal layer 54 and a T-leg portion formed by channel longitudinal layer 56. The T-leg portion is perpendicular to the T-top portion. Side braces 44 have a square or rectangular cross section. Other cross section shapes may be used for the center and/or side braces in other examples. In some examples, side braces 44 may have a T-shape cross section instead or, or in addition, to center braces 42.

In the example shown in FIGS. 1-5, braces 40 additionally includes a cloth layer 66 adjacent and attached to base longitudinal layer 54 and spaced from channel longitudinal layer 56. In other words, base longitudinal layer 54 is disposed between cloth longitudinal layer 66 and channel longitudinal layer 56. In one example, the cloth longitudinal layer may be made of carbon fiber cloth embedded in epoxy, while base and channel longitudinal layers may be made of one or more wood materials.

Soundboard 20 additionally includes a plurality of pockets or cavities 68 separate from the brace channels. The cavities have any suitable shape(s), size(s), and/or pattern(s) that control the acoustic response of the stringed instrument having soundboard 20, such as by providing a desired effect on the amplitude and/or mode shape of the vibrating surface. Additionally, the cavities may reduce the mass and/or stiffness of the soundboard or backboard.

Figure 6:
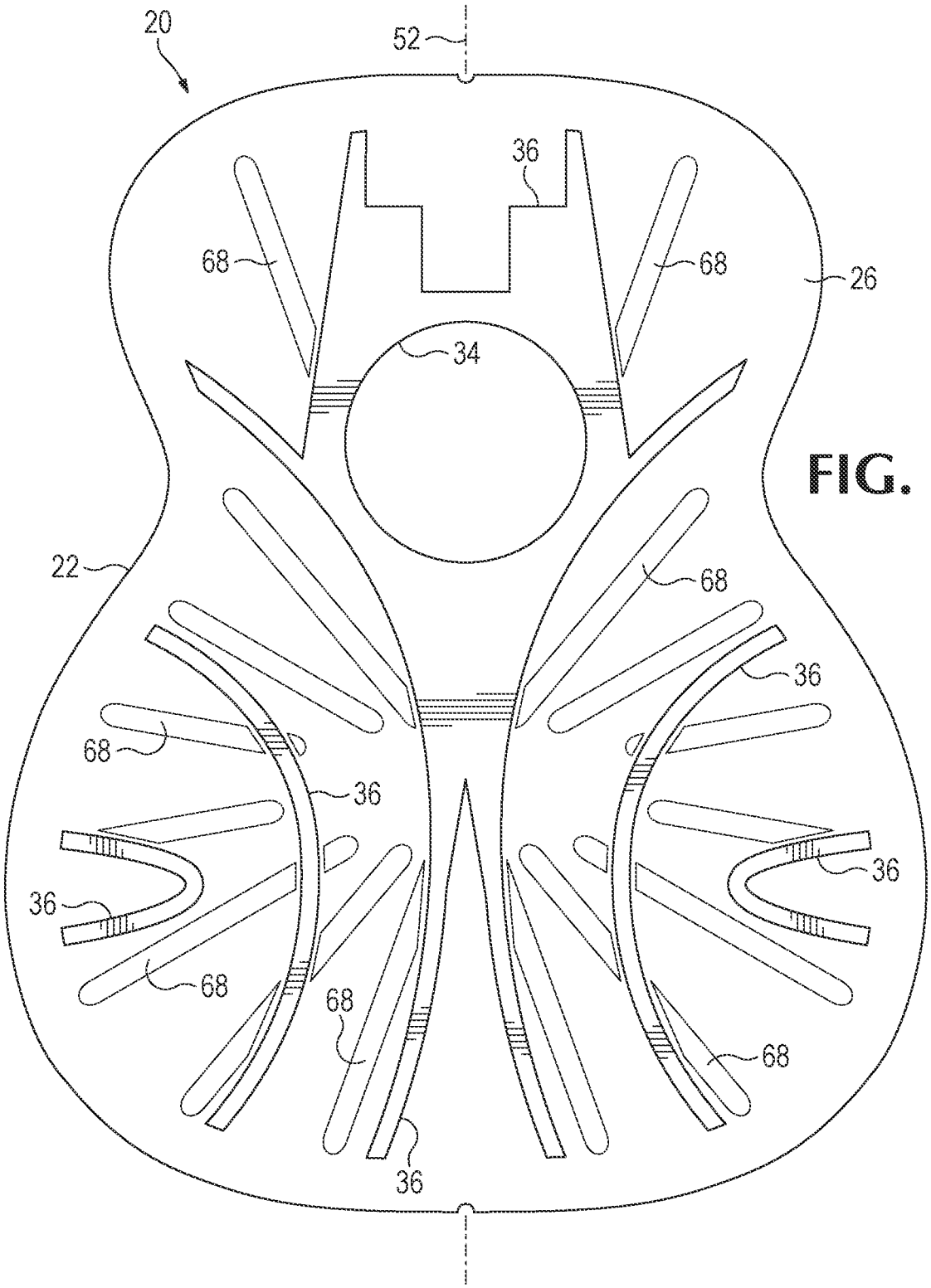
FIG. 6 is a bottom view of another example of a guitar soundboard shown without braces.

Each cavity 68 is made of one or more side walls 70 and a bottom or bottom wall 71. In the example shown in FIGS. 1-5, cavities 68 are hexagonal with each cavity having six side walls 70. The hexagonal cavities are arranged in a honeycomb pattern in which one or more cavities 68 are each surrounded by six cavities 68 in which each adjacent pair of cavities 68 share at least one common wall 70. Another example of cavities 68 is shown in FIG. 6 in which the cavities 68 are elongate and are symmetrical (or are mirror images) about longitudinal axis 52. Other examples of soundboard 20 may include cavities 68 that are shaped differently based on desired acoustic response of the stringed instrument. Additionally, the depth of the cavities may be the same or different from each other and generally is about 0.030 inches to about 0.050 inches.

The cavities may be distributed on any suitable portion(s) of bottom surface 26 of base 22. In the example shown in FIGS. 1-5, cavities 34 are distributed along a substantial portion of bottom surface 26 except for brace channels 36, a perimeter portion 72, a bridge portion 73, and a soundhole portion 74. Other examples of soundboard 20 may include cavities 34 that are distributed differently than shown in FIGS. 1-5 and/or have one or more additional portions without the cavities. Although FIGS. 1-6 show soundboard 20, a backboard may include the same or similar structures, such as brace channels 36, braces 40, and/or cavities 68.

Figure 7:
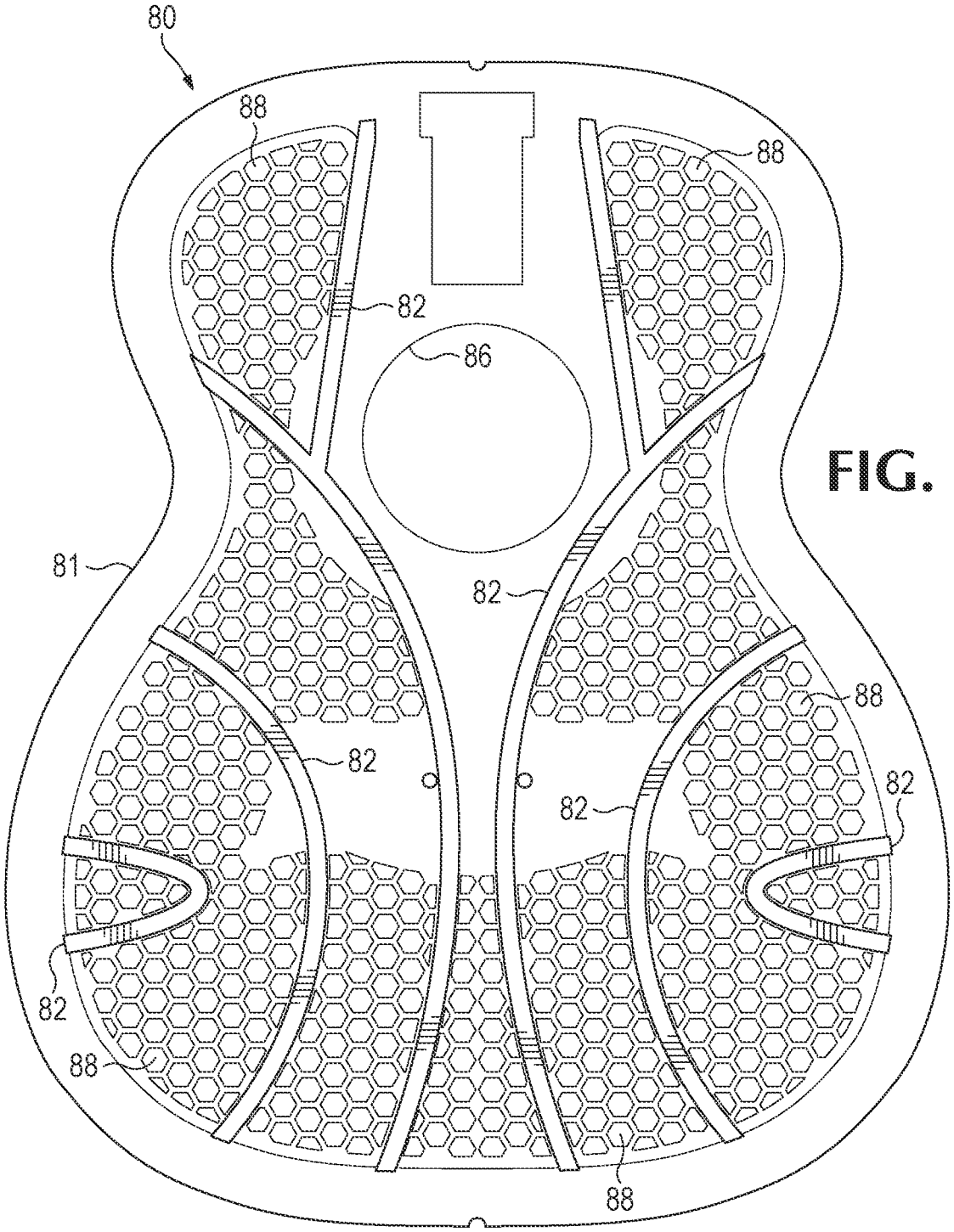
FIG. 7 is a bottom view of a further example of a guitar soundboard shown without braces.
Figure 8:
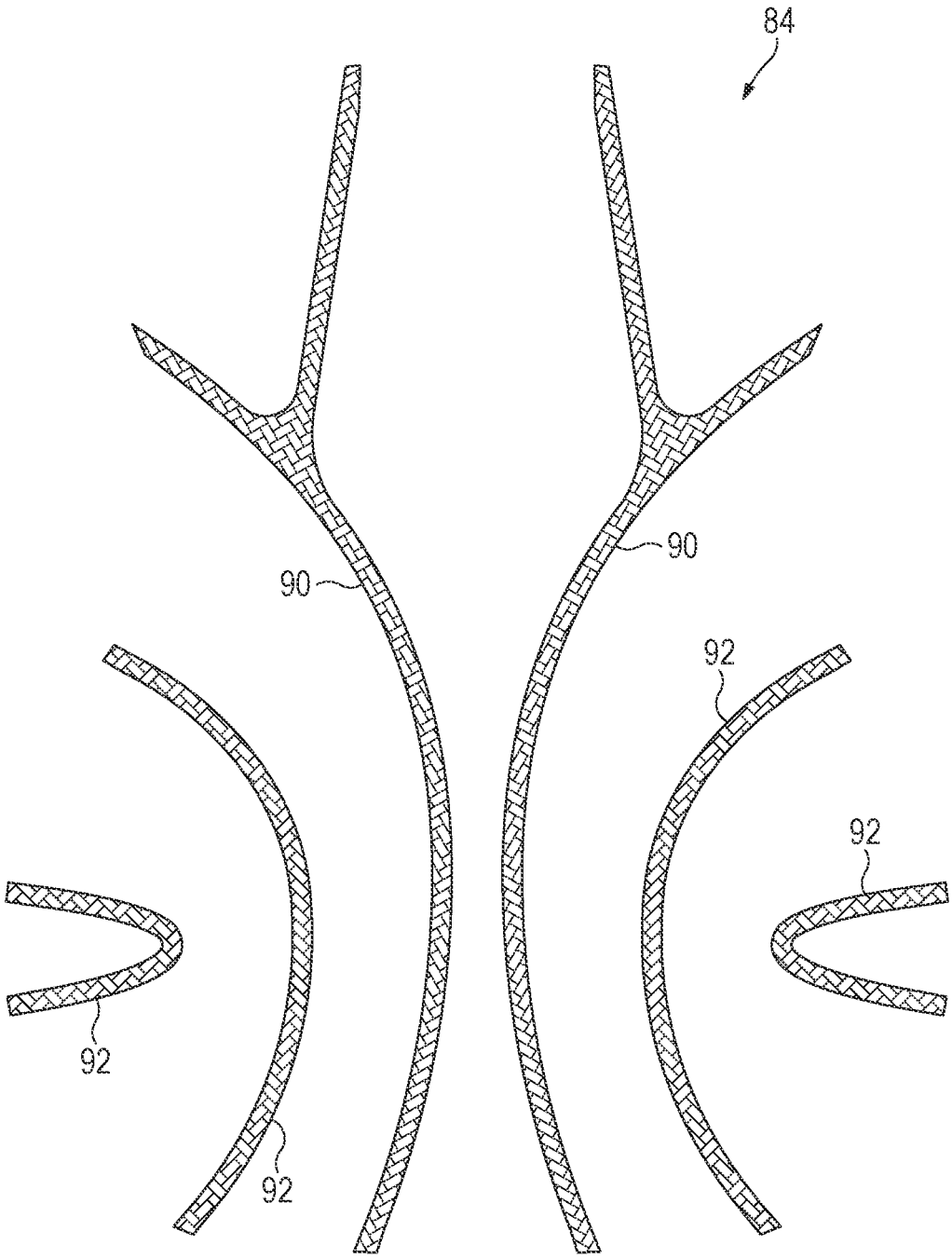
FIG. 8 is a bottom view of braces of the guitar soundboard of FIG. 7.

Referring to FIGS. 7-8, another example of soundboard 20 is generally indicated at 80. Unless explicitly excluded, soundboard 80 may include any structures and/or components of other soundboards or backboards of the present disclosure. Similar to the previous soundboard, soundboard 80 includes a base 81 having brace channels 82, braces 84, a soundhole 86, and cavities 88 that are hexagonal and in a honeycomb pattern. However, unlike the braces of the previous soundboard, braces 84 have a square or rectangle cross section (not a T-shaped cross section) and the center braces do not form a hole that is co-axial with the soundhole. Additionally, center braces 90 of braces 84 are generally Y-shaped, while side braces 92 of braces 84 are U- or C-shaped.

Figure 9:
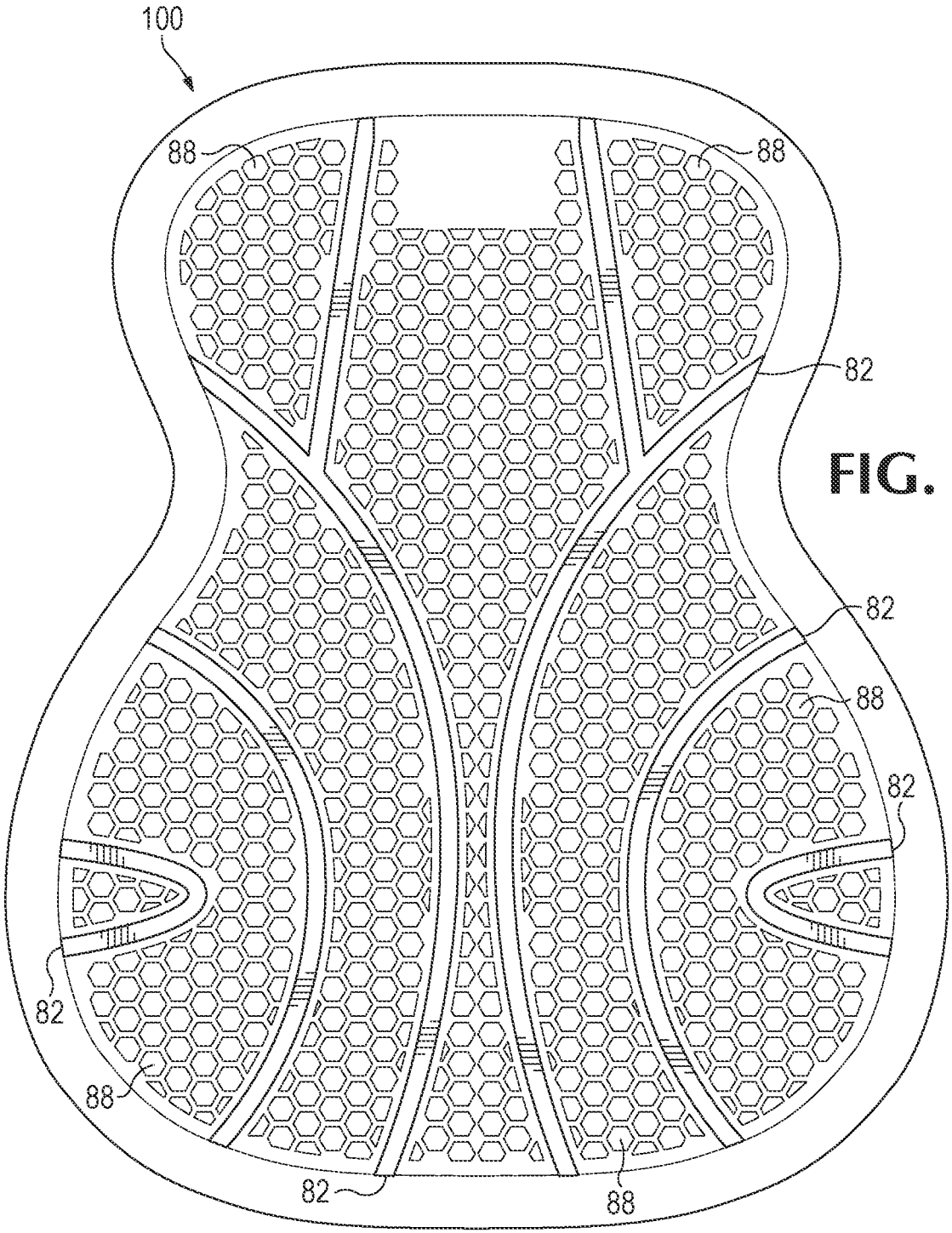
FIG. 9 is a top view of an example of a guitar backboard shown without braces.

Referring to FIG. 9, an example of a backboard 100 is shown. Unless explicitly excluded, soundboard 80 may include any structures and/or components of other soundboards or backboards of the present disclosure. In this particular example, backboard 90 includes substantially the same components as soundboard 80 except for soundhole 86. Specifically, backboard 100 includes brace channels 82, braces 84 (shown in FIG. 8), and cavities 88. Although FIGS. 1-9 show soundboards and backboards having both brace channels and cavities, other examples of soundboards and backboards may include only brace channels without or excluding cavities, or only cavities without or excluding brace channels (in which the braces are attached directly to the bottom surface of the base and not received in any brace channels).

Figure 10:
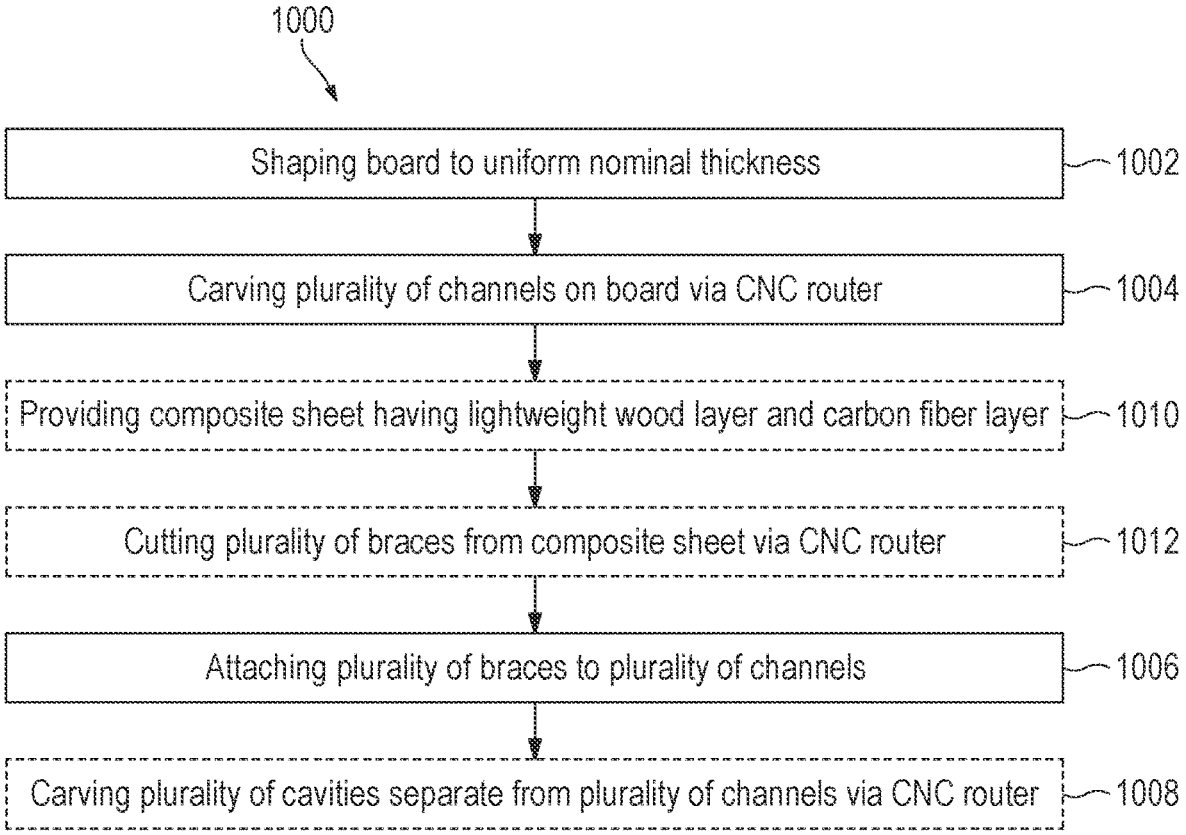
FIG. 10 is a flowchart showing an example of a process for manufacturing a guitar soundboard or backboard.

Referring to FIG. 10, an example of a method 1000 of manufacturing a soundboard or backboard for an acoustic stringed instrument is shown. At 1002, a base or board for a soundboard or backboard is shaped to a uniform thickness, such as via a drum sander. As part of the shaping, the edges of the board may be straightened to ensure that there are no gaps when the board is attached to other components of the acoustic stringed instrument. The straightening of edges may be performed on a plurality of boards placed on top of each other on a Computer Numerically Controlled (CNC) router bed and clamped down at the ends. A suitable router bit, such as a 0.25 inch end mill router bit, is placed in the CNC spindle. Subsequently, a tool path in the form of a straight line is loaded, and the Z-axis is set to zero on the router bed. The X- and Y-axes are set to zero at the edge to be cut in the middle of the board. The toolpath is run until a straight and smooth line is cut across the boards. The boards are then removed from the CNC router bed.

After the edges of the board are straightened, a strip of wood glue (e.g., Titebond wood glue) may be liberally spread on the edges of the board. One side may be pressed into the other side of the board while the board lies flat on the surface of a workbench. The two sides of the board may be pressed together and fixed in place until the glue has dried. Pieces of stretch tape may be used over the seam to hold pieces together, and the pieces are not moved for two hours or until the glue dries. The board may then be processed again to ensure uniform thickness, such as run through a drum sander once again to remove the strip of glue and to ensure the piece is the same thickness throughout.

At 1004, a plurality of brace channels is carved or routed on the bottom surface of the board. The thickness of the board is measured and the measurements are input into a software program such that toolpaths are calculated based on thickness of the board. Those toolpaths are loaded into a CNC router and a suitable router bit is inserted (e.g., 0.125 inch end mill router bit). A spoiler board of a slightly larger size than the board may be used. Strips of double stick tape may be used to attach the board to be routed to the spoiler board and the spoiler board may be clamped on the CNC router bed. The Z-axis of the spindle may be set to zero on top of the board and the X- and Y-axes may be set to zero in the center of the board. The toolpath is run to carve or route the brace channels. When the toolpath is finished, the spoiler and board may be removed from the CNC router bed and subsequently cleaned. The routed board may be pried up using a paint scraper, further shaped, certain portions cut out, and the board cleaned up.

At 1006, braces are attached, such as fastened or glued, to the brace channels of the base. The braces correspond to the brace channels such that at least a portion of the braces are received in the brace channels. When the braces have a T-shaped cross-section, the braces are positioned such that the T-leg portion is received in the brace channels. In some examples, method 1000 may include steps to prepare the braces prior to attachment to the brace channels. For example, at 1010, a composite sheet with a lightweight wood layer and a carbon fiber layer is provided. The composite sheet may be made from a lightweight wood layer, embedding a carbon fiber layer (or other suitable fabric layer) with epoxy or other suitable adhesive, and attaching the carbon fiber layer to the lightweight wood layer.

In some embodiments, a piece of wax paper is lay underneath the carbon fiber, where AB epoxy is mixed together and generously applied to the wood. The brace board is placed on top of the carbon fiber evenly for pressing. A wood board of the same size may be placed on top of the brace board and the carbon fiber fabric, and the two are then pressed into place using multiple three pound weights. This step may take up to 12 to 24 hours of drying and pressing to ensure the brace board, the carbon fiber fabric, and the epoxy are all securely assembled and compressed together. Additionally, at 1012, the braces may be cut from the composite sheet, such as via a CNC router. The shape of the braces may be designed to achieve an optimal mass to stiffness ratio. The width of the braces, such as the layer not received in the brace channels and/or the layer outside the brace channels, may be changed to provide different levels of stiffness.

In some examples, method 1000 may include carving or routing cavities separate from the brace channels to control acoustic response of the soundboard or backboard at 1008, such as via a CNC router. For example, one or more (or all) of the cavities may be hexagonal or elongate. The cavities may be carved or routed to any suitable pattern(s), such as a honeycomb pattern. Although FIG. 10 shows particular steps for a process of manufacturing a soundboard or backboard for an acoustic stringed instrument, other examples of the process may add, omit, replace, repeat, and/or modify one or more steps. For example, other embodiments of method 1000 may exclude step 1004 or step 1008. Additionally, the steps shown in FIG. 10 may be performed in any suitable order and two or more steps may be performed concurrently or simultaneously. For example, steps 1004 and 1008 may be performed concurrently via a CNC router.

Example Features

This section describes additional aspects and features of the soundboards and backboards and the process of manufacturing the same, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing, without limitation, examples of some of the suitable combinations.

A. A soundboard assembly, comprising:

(a) a soundboard having a front and back surface;

(b) pockets repeatedly routed throughout the back surface of the soundboard along a common axis to form a geometrical matrix;

(c) a brace assembly including a pair of Y-shape center braces, and two pairs of curved braces, each individual brace having a T-shaped support structure, where the support structure has a narrow vertical post in contact with the soundboard, as well as a pair of flanges protruding out laterally above the vertical post forming a cap of the support structure.

A1. The assembly of A wherein the pockets are a hexagon, and the matrix is a honeycomb shape.

A2. The assembly of A1 wherein each individual brace has a top surface, the top surface has a layer of epoxy immediately thereon, and a layer of carbon fiber cloth immediately thereon the epoxy.

A3. The assembly of A2 wherein the Y-shaped center braces are placed around the center of the back surface of the soundboard, and the two pairs of curved braces include a pair of longer curved braces and a pair of shorter curved braces, and the longer curved braces are placed in an outward location relative to the Y-shaped braces with the pair of shorter curved braces placed outward relative to the longer curved braces on the soundboard.

B. A soundboard assembly, comprising:

(a) a soundboard having a front and back surface;

(b) pockets repeatedly routed throughout the back surface of the soundboard along a common axis to form a geometrical matrix, where the pockets are a hexagon, and the matrix is a honeycomb shape.

C. A soundboard assembly, comprising:

(a) a soundboard having a front and back surface;

(b) a brace assembly attached to the back surface of the soundboard, the brace assembly including a pair of Y-shape center braces, and two pairs of curved braces, each individual brace having a T-shaped support structure, where the support structure has a narrow vertical post in contact with the soundboard, as well as a pair of flanges protruding out laterally above the vertical post forming a cap of the support structure.

C1. The assembly of C, wherein each individual brace has a top surface, and the top surface has a layer of epoxy on top, and a layer of carbon fiber cloth on top the layer of epoxy.

D. A soundboard or backboard of an acoustic stringed instrument, comprising:

a base having opposed top and bottom surfaces;

a plurality of channels on the bottom surface of the base; and a plurality of braces that correspond to the plurality of channels and that are received in and attached to the plurality of channels.

D1. The soundboard or backboard of D, wherein the base further includes a plurality of cavities separate from the plurality of channels.

D2. The soundboard or backboard of D1, wherein one or more cavities of the plurality of cavities are hexagonal.

D3. The soundboard or backboard of D2, wherein each cavity of the plurality of cavities is hexagonal.

D4. The soundboard or backboard of D3, wherein the plurality of cavities is arranged in a honeycomb pattern.

D5. The soundboard or backboard of any of D1 to D4, wherein each cavity of the plurality of cavities is elongate.

D6. The soundboard or backboard of any of D1 to D5, where the base defines a longitudinal axis and wherein the plurality of cavities is symmetrical about the longitudinal axis.

D7. The soundboard or backboard of any of D to D6, wherein one or more of the plurality of braces include a first longitudinal layer and a second longitudinal layer formed with the first longitudinal layer, the first longitudinal layer having a first length and a first width and the second longitudinal layer having a second length and a second width, the first and second length being substantially the same, and the second width along at least a substantial portion of the second length being smaller than the first width along the corresponding portion of the first length.

D8. The soundboard or backboard of D7, wherein the one or more of the plurality of braces includes a third longitudinal layer attached to the first longitudinal layer, the first and second longitudinal layers being made of one or more wood materials, and the third longitudinal layer being made of carbon fiber cloth embedded in epoxy.

D9. The soundboard or backboard of D7 or D8, wherein the one or more of the plurality of braces has a T-shaped cross section having a T-top portion and a T-leg portion that is perpendicular to the T-top portion, the T-top portion being formed by the first longitudinal layer, and the T-leg portion being formed by the second longitudinal layer.

D10. The soundboard or backboard of any of D to D9, wherein the plurality of braces includes a wood layer and a layer having carbon fiber cloth embedded in epoxy attached to the wood layer.

D11. The soundboard or backboard of any of D to D10, where the base has a base length, and wherein the plurality of braces includes a pair of center braces each having a length that is along a substantial portion of the base length.

D12. The soundboard or backboard of D11, wherein the pair of center braces forms a hole that is co-axial with the soundhole and that has a diameter substantially the same as diameter of the soundhole.

D13. The soundboard or backboard of D12, wherein the pair of center braces are substantially mirror images of each other.

D14. The soundboard or backboard of D12 or D13, wherein the plurality of braces includes first, second, third, and fourth side braces, the first, second, third, and fourth side braces being spaced from each other.

D15. The soundboard or backboard of D14, wherein the pair of center braces are disposed between the first and second side braces and the third and fourth side braces.

D16. The soundboard or backboard of D14 or D15, wherein the first and fourth side braces are mirror images of each other, and the second and third side braces are mirror images of each other.

D17. A soundboard of an acoustic stringed instrument, comprising:

the soundboard or backboard of any of D to D16; and a soundhole of the base;

D18. An acoustic stringed instrument comprising at least one of the soundboard or backboard of any of D to D17.

E. A method of manufacturing a soundboard or backboard for an acoustic stringed instrument, comprising:

shaping a board to a uniform nominal thickness;

carving a plurality of channels on the board via a Computer Numerically Controlled (CNC) router; and attaching a plurality of braces that correspond to the carved plurality of channels such that the plurality of braces is received in the plurality of channels.

E1. The method of E, further comprising carving a plurality of cavities separate from the plurality of channels to control acoustic response of the guitar soundboard.

E2. The method of claim E1, wherein carving a plurality of cavities separate from the plurality of channels to control acoustic response of the guitar soundboard includes carving the plurality of cavities such that one or more cavities of the plurality of cavities are hexagonal.

E3. The method of claim E2, wherein carving the plurality of cavities such that one or more cavities of the plurality of cavities are hexagonal includes carving the plurality of cavities such that each cavity of the plurality of cavities are hexagonal.

E4. The method of claim E3, wherein carving the plurality of cavities such that each cavity of the plurality of cavities are hexagonal includes carving the plurality of cavities such that the plurality of cavities is in a honeycomb pattern.

E5. The method of any of E1 to E4, further comprising:

providing a composite sheet having a lightweight wood layer and a carbon fiber layer; and cutting the plurality of braces from the composite sheet via a CNC router.

E6. The method of claim E5, wherein providing a composite sheet having a lightweight wood layer and a carbon fiber layer includes:

providing the lightweight wood layer;

embedding the carbon fiber layer with epoxy; and attaching the carbon fiber layer to the lightweight wood layer.

It will be appreciated that the invention is not restricted to the particular embodiment that has been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. A soundboard or backboard of an acoustic stringed instrument, comprising:

a base having opposed top and bottom surfaces;

a plurality of channels on the bottom surface of the base; and a plurality of braces that correspond to the plurality of channels and that are received in and attached to the plurality of channels, wherein one or more of the plurality of braces include a first longitudinal layer and a second longitudinal layer formed with the first longitudinal layer, the first longitudinal layer having a first length and a first width and the second longitudinal layer having a second length and a second width, the first and second length being substantially the same, and the second width along at least a substantial portion of the second length being smaller than the first width along the corresponding portion of the first length.

2. The soundboard or backboard of claim 1, wherein the base further includes a plurality of cavities separate from the plurality of channels.

3. The soundboard or backboard of claim 2, wherein one or more cavities of the plurality of cavities are hexagonal.

4. The soundboard or backboard of claim 3, wherein the plurality of cavities is arranged in a honeycomb pattern.

5. The soundboard or backboard of claim 2, where the base defines a longitudinal axis and wherein the plurality of cavities is symmetrical about the longitudinal axis.

6. The soundboard or backboard of claim 1, wherein the one or more of the plurality of braces includes a third longitudinal layer attached to the first longitudinal layer, the first and second longitudinal layers being made of one or more wood materials, and the third longitudinal layer being made of carbon fiber cloth embedded in epoxy.

7. The soundboard or backboard of claim 1, wherein the one or more of the plurality of braces has a T-shaped cross section having a T-top portion and a T-leg portion that is perpendicular to the T-top portion, the T-top portion being formed by the first longitudinal layer, and the T-leg portion being formed by the second longitudinal layer.

8. The soundboard or backboard of claim 1, wherein the plurality of braces includes a wood layer and a layer having carbon fiber cloth embedded in epoxy attached to the wood layer.

9. A soundboard or backboard of an acoustic stringed instrument, comprising:

a base having opposed top and bottom surfaces;

a plurality of channels on the bottom surface of the base; and a plurality of braces that correspond to the plurality of channels and that are received in and attached to the plurality of channels where the base has a base length, and wherein the plurality of braces includes a pair of center braces each having a length that is along a substantial portion of the base length, and wherein the pair of center braces forms a hole that is co-axial with the soundhole and that has a diameter substantially the same as diameter of the soundhole.

10. A soundboard of an acoustic stringed instrument, comprising:

the soundboard or backboard of claim 1; and a soundhole of the base.

11. An acoustic stringed instrument comprising at least one of the soundboard or backboard of claim 1.

12. A method of manufacturing a soundboard or backboard for an acoustic stringed instrument, comprising:

shaping a board to a uniform nominal thickness;

carving a plurality of channels on the board via a Computer Numerically Controlled (CNC) router;

providing a composite sheet having a lightweight wood layer and a carbon fiber layer;

cutting a plurality of braces from the composite sheet via a CNC router;

attaching the plurality of braces that correspond to the carved plurality of channels such that the plurality of braces is received in the plurality of channels; and carving a plurality of cavities separate from the plurality of channels to control acoustic response of the guitar soundboard, wherein carving a plurality of cavities separate from the plurality of channels to control acoustic response of the guitar soundboard includes carving the plurality of cavities such that one or more cavities of the plurality of cavities are hexagonal, wherein carving the plurality of cavities such that one or more cavities of the plurality of cavities are hexagonal includes carving the plurality of cavities such that each cavity of the plurality of cavities are hexagonal, and wherein carving the plurality of cavities such that each cavity of the plurality of cavities are hexagonal includes carving the plurality of cavities such that the plurality of cavities is in a honeycomb pattern.

13. The method of claim 12, wherein providing a composite sheet having a lightweight wood layer and a carbon fiber layer includes:

providing the lightweight wood layer;

embedding the carbon fiber layer with epoxy; and attaching the carbon fiber layer to the lightweight wood layer.

14. The soundboard or backboard of claim 9, wherein the base further includes a plurality of cavities separate from the plurality of channels.

15. The soundboard or backboard of claim 14, wherein one or more cavities of the plurality of cavities are hexagonal.

16. The soundboard or backboard of claim 15, wherein the plurality of cavities is arranged in a honeycomb pattern.

17. The soundboard or backboard of claim 14, where the base defines a longitudinal axis and wherein the plurality of cavities is symmetrical about the longitudinal axis.

18. The soundboard or backboard of claim 9, wherein the plurality of braces includes a wood layer and a layer having carbon fiber cloth embedded in epoxy attached to the wood layer.

19. The soundboard or backboard of claim 9, where the base has a base length, and wherein the plurality of braces includes a pair of center braces each having a length that is along a substantial portion of the base length.

20. A soundboard of an acoustic stringed instrument, comprising:

the soundboard or backboard of claim 9; and a soundhole of the base.

* * * * *